US010767432B1

(12) United States Patent
Hewitt et al.

(10) Patent No.: US 10,767,432 B1
(45) Date of Patent: Sep. 8, 2020

(54) DRILL ALIGNMENT DEVICE

(71) Applicants: Tressie L. Hewitt, Oak Ridge, TN (US); Michael J. Hewitt, Amite, LA (US)

(72) Inventors: Tressie L. Hewitt, Oak Ridge, TN (US); Michael J. Hewitt, Amite, LA (US)

( * ) Notice: Subject to any disclaimer, the term of this patent is extended or adjusted under 35 U.S.C. 154(b) by 364 days.

(21) Appl. No.: 15/834,955

(22) Filed: Dec. 7, 2017

Related U.S. Application Data

(60) Provisional application No. 62/431,177, filed on Dec. 7, 2016.

(51) Int. Cl.
*E21B 31/00* (2006.01)

(52) U.S. Cl.
CPC ..... *E21B 31/007* (2013.01)

(58) Field of Classification Search
CPC ..... E21B 31/18; E21B 31/00; E21B 31/007
See application file for complete search history.

(56) References Cited

U.S. PATENT DOCUMENTS 2,912,273 A 11/1959 Chadderdon, Jr. et al.
2,955,655 A 10/1960 Ware
4,501,336 A 2/1985 Kemp et al.
4,792,000 A 12/1988 Perkin et al.
5,141,275 A 8/1992 Walsh
6,857,487 B2 2/2005 Galloway et al.
2005/0217858 A1 10/2005 Galloway et al.
2009/0114451 A1 5/2009 Wenzel
2013/0022401 A1* 1/2013 Magowan ..... E21B 43/0122 405/60
2015/0082753 A1* 3/2015 Fuller ..... B65D 19/44 53/473
2015/0176370 A1* 6/2015 Greening ..... E21B 19/06 166/250.01

* cited by examiner

*Primary Examiner* — Shane Bomar
(74) *Attorney, Agent, or Firm* — Cramer Patent & Design, PLLC; Aaron R. Cramer

(57) ABSTRACT

A well drilling fishing equipment alignment device that includes a base and an inner support that is connected to and that extends from that base. The inner support is configured to receive, hold, and vertically align an equipment retrieval device, typically an overshot. Also included is an outer cover that is configured to cover and protect at least a portion of the equipment retrieval device when it is connected to the inner support. The base provides a flat bottom and a handling feature. The inner support includes a preferably hollow vertical support member that includes a lower end guide support that mates with a feature of the equipment retrieval device. Beneficially the guide support includes a perimeter lip that engages a bottom edge of an equipment retrieval device guide to form a joint.

12 Claims, 5 Drawing Sheets

DRILL ALIGNMENT DEVICE

RELATED APPLICATIONS

The present invention was first described in and claims the benefit of U.S. Provisional Application No. 62/431,177 filed Dec. 7, 2016, the entire disclosures of which are incorporated herein by reference.

FIELD OF THE INVENTION

The presently disclosed subject matter is directed to well drilling alignment devices for assisting the assembly of equipment retrieval tools.

BACKGROUND OF THE INVENTION

During gas or oil well drilling an all-too-frequent occurrence is that drilling equipment becomes lost in the well. Because of the cost of new equipment, the time required to procure that new equipment and to set it in place, and the need to clear a well so that drilling can continue it is often advantageous to retrieve such lost equipment. The process of doing so is commonly known in the drilling industry as "fishing".

A "fishing" expedition is performed by lowering one (1) or more equipment retrieval tools into the well. Equipment retrieval tools are designed to grasp or otherwise interact with the lost drilling equipment such that the equipment can be removed to enable continued drilling operations. A fishing expedition typically involves trying to couple one (1) or more retrieval tools to the lost drilling equipment, hopefully to enable both the retrieval tools and the lost drilling equipment to be removed from the well. Fishing operations should be understood as including the application of tools, equipment and techniques for the removal of junk, debris, tools and anything else left in a well bore.

One (1) common fishing tool is the overshot. An overshot is a well-drilling fishing tool that attaches to well tubing or pipe. An overshot is dropped down the well such that the overshot encompasses the outside walls of the drilling tube or pipe. Once the overshot is in place a basket grapple "grabs" the well tubing and allows the application of tensile forces and jarring actions such that the tubing can be pulled from the well. If the "fish" cannot be removed, a release system within the overshot allows the overshot to be disengaged and retrieved. As used herein "overshot" should be understood as having its customary meaning known to those skilled in drilling operations.

The assembly of fish equipment retrieval tooling is usually performed on the surface. Because of the nature of oil and gas well drilling it can be critical to perfectly align the equipment retrieval tooling to enable it to be dropped down a well to the lost equipment. Perfect alignment is easily said, but in practice it is far more difficult to accomplish in field conditions.

Accordingly, there exists a need for a system by which equipment retrieval tooling can be stabilized and carefully aligned. Preferably such alignment involves accurate vertical alignment such that a first section of the equipment retrieval tooling is vertically aligned with the second section, and then the third and subsequent sections. In addition, such as system should support proper rigging of fishing equipment as required for the well bore and equipment in issue. Such a system ideally should support safe, rapid assembly of the equipment retrieval tooling. Beneficially such a system should help reduce the chances of damage to the well, to the equipment retrieval tooling itself, and to the drilling equipment being recovered.

SUMMARY OF THE INVENTION

The principles of the present invention provide for an overshot holding device suitable for on-site stabilizing and vertically aligning equipment retrieval tooling. That overshot holding device enables accurate vertical alignment and proper rigging of fishing equipment as required for the well bore and equipment in issue. The overshot holding device supports safe, rapid assembly of the equipment retrieval tooling while helping reduce the chances of damage to the well, to the equipment retrieval tooling itself, and to the drilling equipment being recovered.

A well drilling fishing equipment alignment device that is in accord with the present invention includes a base and an inner support that is connected to and that extends from the base. The inner support is configured to receive, hold, and vertically align an equipment retrieval device. Also included is an outer cover that is configured to cover and protect at least a portion of an equipment retrieval device that is connected to the inner support.

That base can include a base member having a top and a bottom base plate under the base member to provide a flat bottom. The base might further include a handling feature. In practice the inner support includes a vertical support member that is connected at its lower end to the base member. That vertical support member is preferably hollow and includes a lower end guide support that is configured to mate with a feature of an equipment retrieval device. Beneficially the guide support includes a perimeter lip that engages a bottom edge of an equipment retrieval device guide to form a joint. The upper perimeter lip may include a vertically orientated straight edge and a helical edge.

An overshot alignment structure that is in accord with the present invention includes an overshot and an overshot alignment device. The overshot alignment device includes a base and an inner support that is connected to and that vertically extends upward from the base. Also included is an outer cover. The inner support is connected to and vertically aligns the overshot while the outer cover protects at least a portion of the overshot.

That base can include a base member having a top and a bottom base plate under the base member to provide a flat bottom. The base might further include a handling feature. In practice the inner support includes a vertical support member that is connected at its lower end to the base member. That vertical support member is preferably hollow and includes a lower end guide support that mates with the overshot. Beneficially the guide support includes a perimeter lip that engages a bottom edge of a guide in the overshot to form a joint. The upper perimeter lip may include a vertically orientated straight edge and a helical edge.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
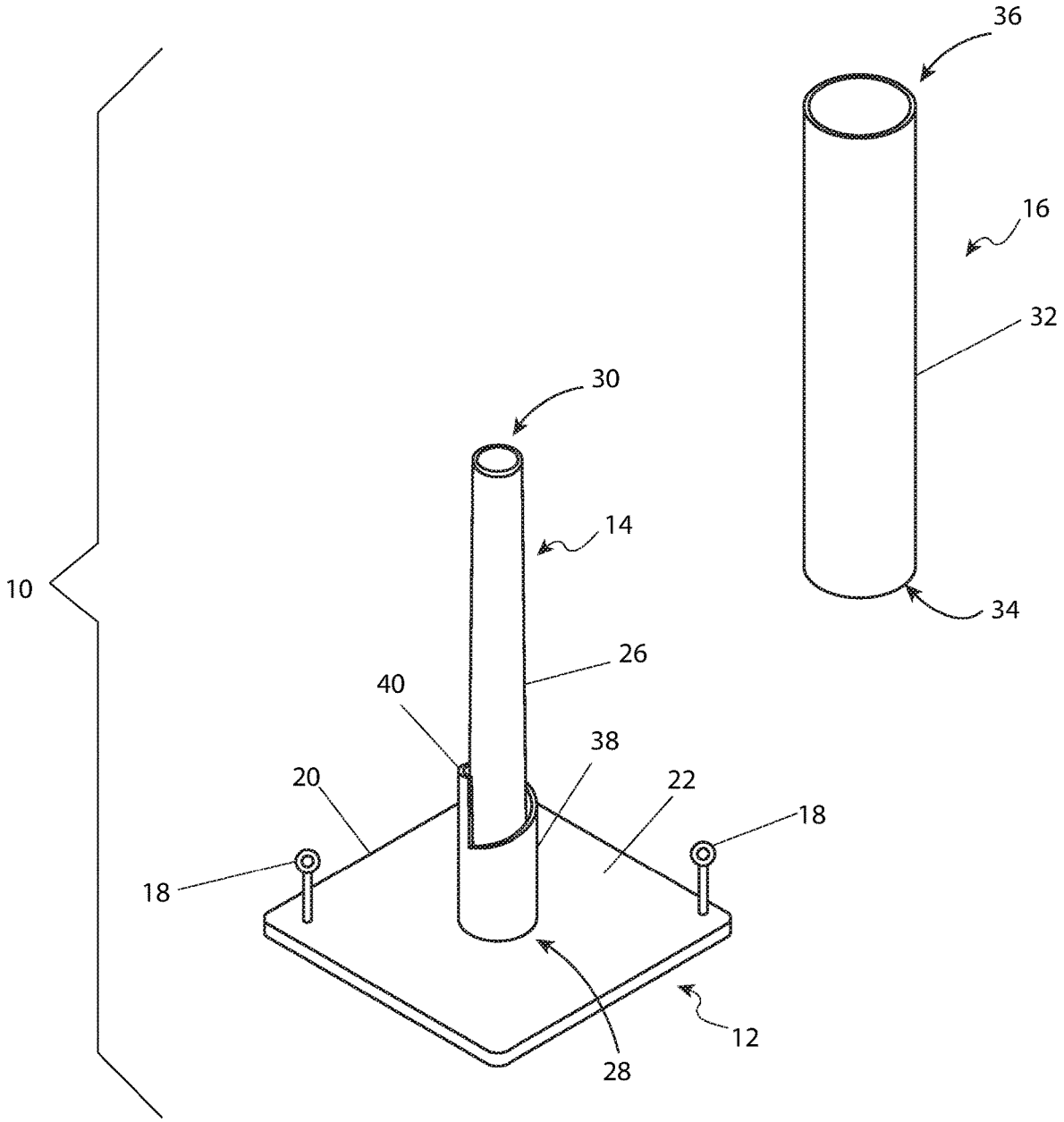
FIG. 1 is an exploded side perspective view of an overshot holding device 10 that is in accord with the principles of the present invention.

10 overshot holding device
12 base
14 inner support
16 outer cover
18 handling feature
20 base member
22 top surface
24 bottom plate
26 support member
28 lower end
30 support member upper end
32 cylindrical cover
34 cover lower end
36 cover upper end
38 guide support
40 lip
42 straight edge
44 helical edge
100 overshot
102 top sub
104 bowl
106 basket grapple
108 guide
110 cutlip guide
112 bottom edge
114 vertical straight edge
116 helical edge
163 vertical joint
165 helical joint

DETAILED DESCRIPTION OF THE PREFERRED EMBODIMENT

Preferred embodiments of the present invention are depicted in FIGS. 1 through 5. However, the invention is not limited to the specifically described embodiments. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one (1) of the referenced items.

The present invention describes a well fishing equipment alignment device in the form of an overshot holding device 10. The overshot holding device 10 is configured to support, hold and protect a vertically orientated overshot 100 which is to be dropped down a well bore to fish for lost drilling equipment. As an example, the overshot holding device 10 may be designed to hold a Bowen™ Series 150 overshot 100. Of course, the overshot holding devices 10 may be used with other types or styles of overshots 100 or with another well fishing tool.

A key to well fishing operations is understanding the dimensions and nature of the fish that is to be removed, the wellbore conditions, the various tools and applicable techniques that can be employed and the process by which the recovered fish will be handled on surface. However, proper alignment of the fishing tools (overshot 100) is a critical parameter if fishing is to be successful. Usually an accurate vertical alignment is required.

Figure 2:
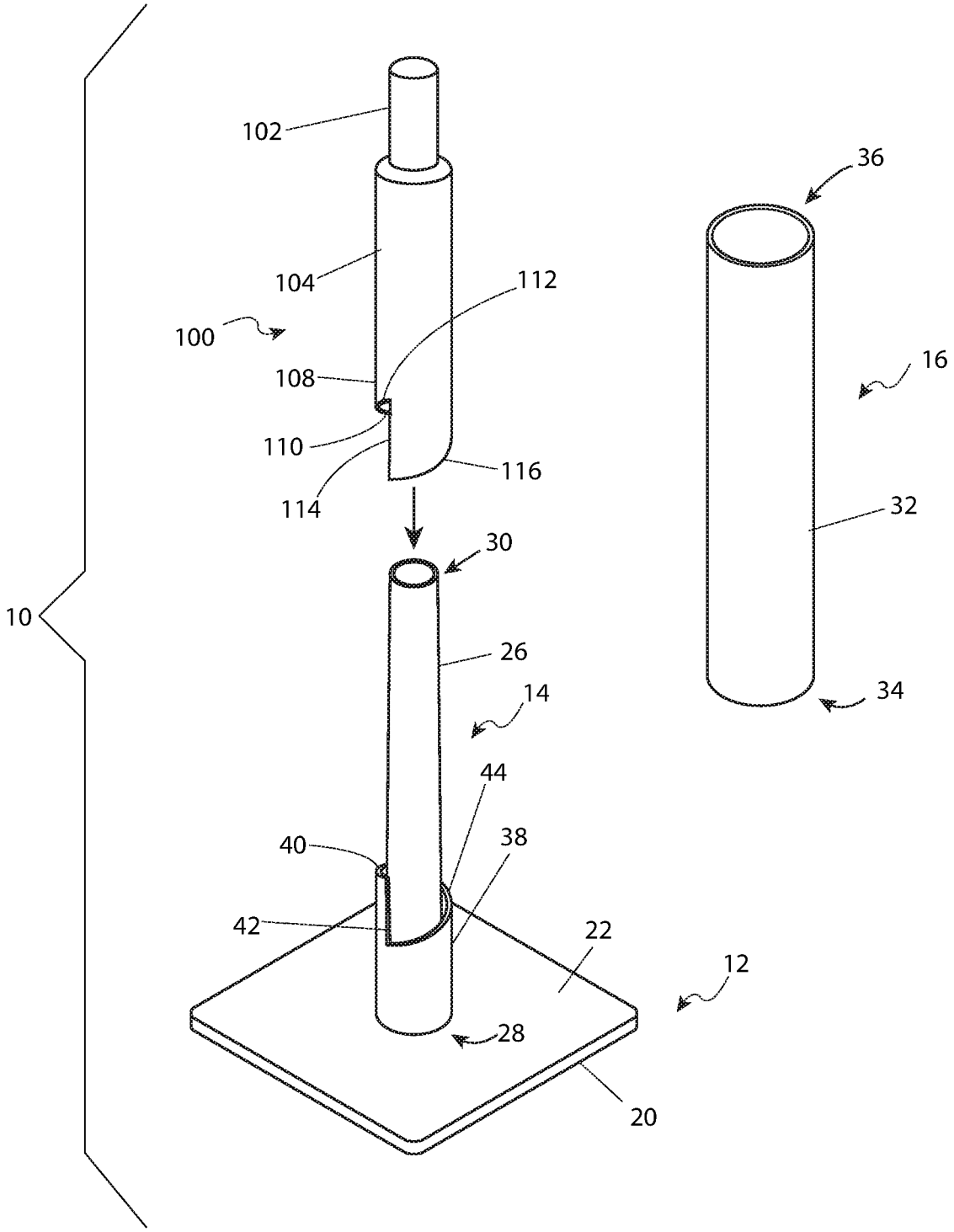
FIG. 2 is an exploded side perspective view of the overshot holding device 10 of FIG. 1 shown with an overshot 100.
Figure 3:
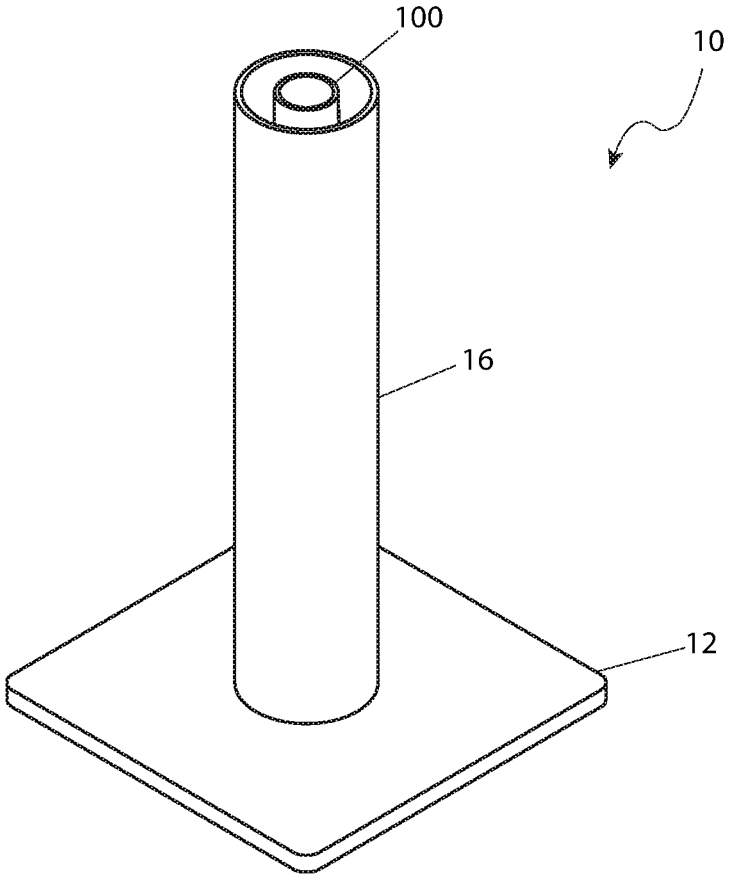
FIG. 3 is a side perspective view of the overshot holding device of FIG. 2 when the overshot 100 and a protective cover 16 are installed on the overshot holding device 10.

FIG. 1 and FIG. 2 present exploded side perspective views of an overshot holding device 10 that provides accurate vertical alignment of an overshot 100. The overshot holding device 10 includes a base 12, an inner support 14 and an outer cover 16. The inner support 14 provides a vertical structure that is at least partially received within an overshot 100 (see FIGS. 2-5 for views of an overshot 100 on the inner support 14). The main purpose of the inner support 14 is to accurately vertically support the overshot 100 during assembly of a fishing equipment tooling assembly that includes the overshot 100. FIG. 3 shows the overshot 100 covered by the outer cover 16 that protects the overshot 100 once it is connected to the inner support 14.

Figure 4:
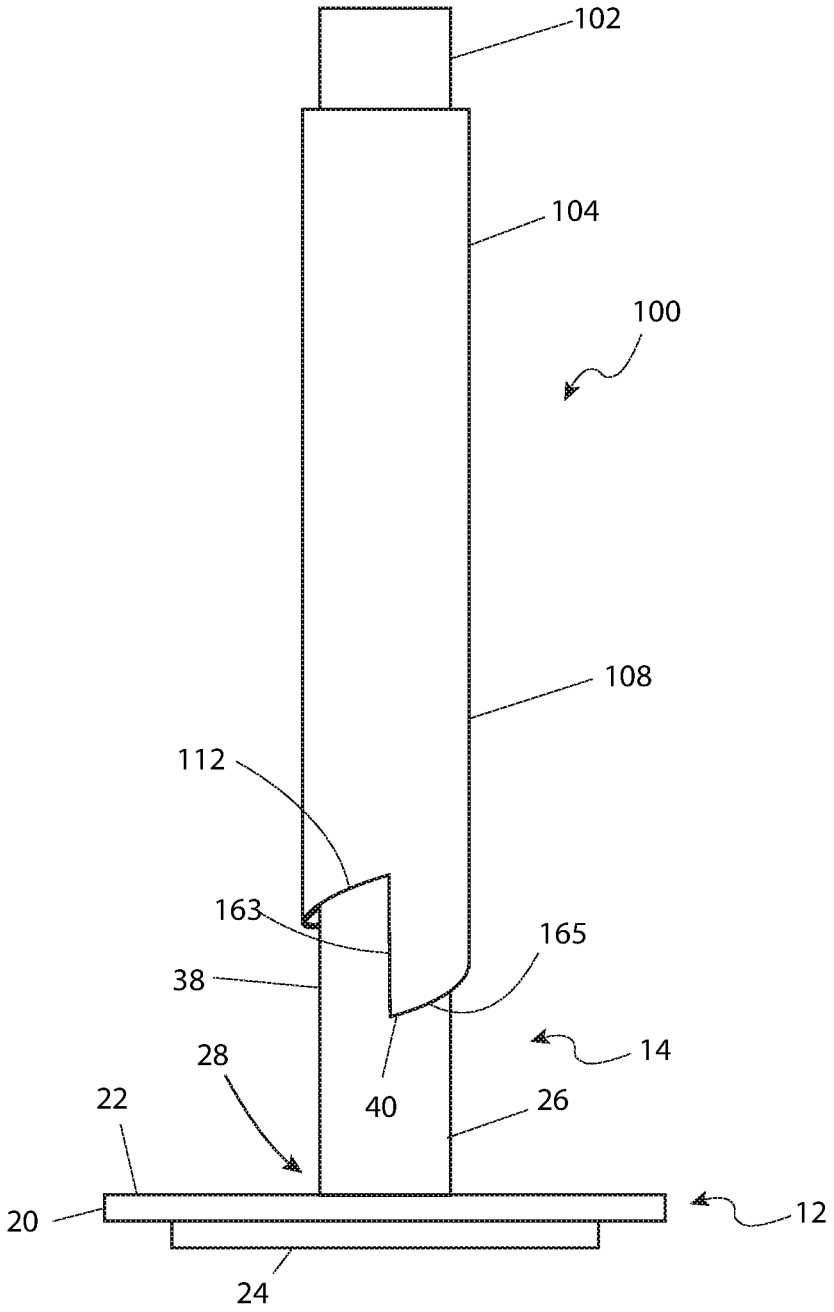
FIG. 4 is a side elevation view of the overshot holding device 10 of FIG. 2 illustrating the overshot 100 being supported; and, FIG. 5 is a partial sectional cut-away view of the overshot holding device 10 of FIG. 3.
Figure 5:
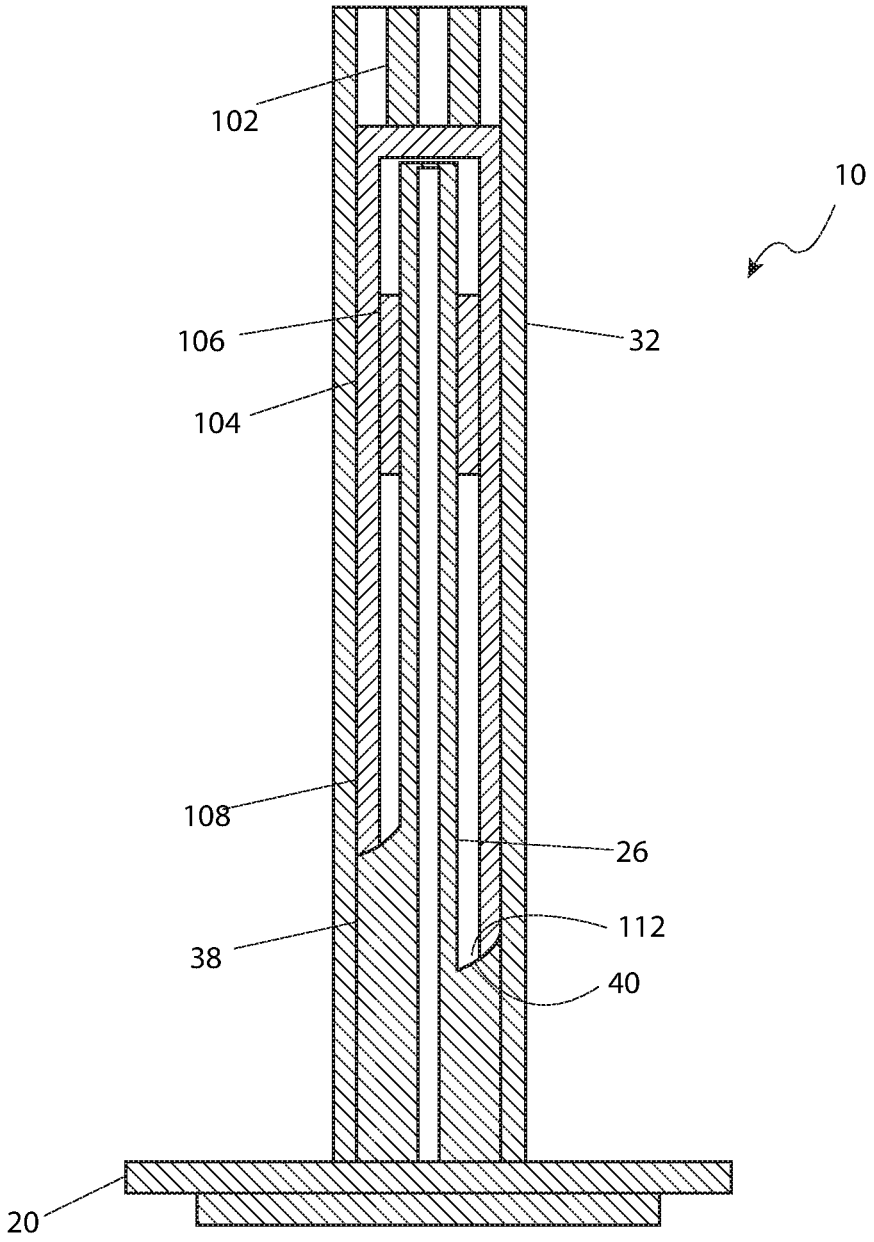

Referring to FIGS. 4 and 5, the base 12 includes both a base member 20 having a top surface 22 and a bottom plate 24 having a flat bottom that is attached under the base member 20. The bottom plate 24 is configured to be supported on an approximately flat surface such as the ground, a drilling pad or the like. While the base member 20 is shown as a square plate it should be understood that the base member 20 may take any suitable shape and/or dimensions required to support the inner support 14, the overshot 100 and the outer cover 16. Thus, the bottom plate 24 supports the overall structure on a flat surface while the base member 20 is configured as required to mate with the inner support 14 and the overshot 100.

FIG. 1 shows the base 12 with optionally included handling features 18. The handling features 18 allow the overshot holding device 10 and the connected overshot 100 to be moved or otherwise transported between different locations. The handling feature 18 beneficially takes the form of a lifting eye bolt or hoist ring that is connected to the base member 20 and which extends from the top surface 22. FIGS. 2-5 show the base 12 without a handling feature 18.

Referring to FIGS. 1, 2, and 4, as noted the inner support 14 extends upward from the base 12. The inner support 14 includes a vertically extending support member 26 that is connected at its lower end to the base member 20 and which extends upward to an upper end 30. In practice the support member 26 will usually be disposed at or near the center of the base member 20. To reduce weight the support member 26 is beneficially a hollow tube or pipe.

Referring primarily to FIGS. 1-3, the outer cover 16 fits over the overshot 100 when the overshot 100 is connected to the inner support 14. The outer cover 16 includes a cylindrical cover 32 that protects the overshot 100. The cylindrical cover 32 has a cover lower end 34 and an opposed cover upper end 36.

FIG. 4 shows a typical overshot 100 having a top sub 102, a connected bowl 104 and a guide 108. As previously noted the overshot 100 is used in to remove an article (not shown) from within a well bore (also not shown). To that end the top sub 102 is configured to connect (e.g., thread onto) an extension sections as required to move the overshot 100 down a well bore.

Referring to FIGS. 1, 2, 4, and 5, the support member 26 has a guide support 38 that is disposed at or near its lower end 28. The guide support 38 is configured to engage and mate with the guide 108 of the overshot 100 when the support member 26 is fully inserted into the overshot 100 (best shown in FIG. 5). The guide support 38 itself includes an upper perimeter lip 40 that engages the bottom edge 112 of the guide 108 at the entry to a cutlip guide 110. The lip 40 includes a straight edge 42 (e.g., generally parallel to a center axis of the inner support 14) and a helical edge 44.

The lip 40 matches the shape or configuration of the bottom edge 112 of the overshot 100 that is being used. As an example, the bottom edge 112 includes a vertical straight edge 114 and a helical edge 116.

FIG. 4 best illustrates the overshot 100 when it is connected to and supported by the inner support 14. Upon full insertion of the support member 26 within the overshot 100 the straight edge 42 engages the vertical straight edge 114 along a vertical joint 163 and the helical edge 44 mates with the helical edge 116 to form a helical joint 165. In this configuration the overshot 100 is supported in the upright position while the vertical joint 163 prevents rotation of the overshot 100 on the support member 26.

Referring now to FIGS. 2, 4, and 5, the bowl 104 houses a basket grapple 106 and/or another type of gripping mechanisms. The guide 108 is designed to guide the overshot 100 through a well bore. In an illustrative example the guide 108 forms the cutlip guide 110 with the bottom edge 112 having the vertical straight edge 114 and a helical edge 116 which respectively form the vertical joint 163 and the helical joint 165. The specific features and operation of the overshot 100 are known to those skilled in the art and need not be further described.

FIG. 5 is a partial schematic cut-away view of the device 10 illustrating the overshot 100 connected to and supported by the inner support 14 and covered by the outer cover 16. As illustrated, the support member 26 is at least partially received within the overshot 100. The support member 26 has an outer diameter that is less than but close to the inner diameter of the overshot 100. The support member 26 is received and engaged by the basket grapple 106 when inserted into the overshot 100. The outer diameter of the guide support 38 is approximately equal to the outer diameter of the overshot 100. The inner diameter of the cylindrical cover 32 is larger than but close to that of the outer diameter of the guide support 38 and the overshot 100.

The overshot holding device 10 provides various benefits and advantages including support of the overshot 100 in the upright (e.g., vertical) position, which allows more efficient assembly of fishing equipment while reducing the possibility of injury to a laborer or damage to the overshot 100. The overshot holding device 10 also provides a safe and secure means to store the overshot 100 in the upright position during non-use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A well drilling fishing equipment alignment device, comprising:

a base;

an inner support connected to and extending from said base, said inner support configured to receive, hold, and vertically align an equipment retrieval device;

an outer cover configured to cover and protect at least a portion of an equipment retrieval device connected to said inner support and, wherein said base includes a base member having a top, wherein said base further includes a bottom base plate under the base member, wherein said base plate provides a flat bottom, wherein said base further comprises at least one handling feature that extends upward from said top, wherein said inner support includes a vertical support member that is connected at its lower end to said base member.

2. The well drilling fishing equipment alignment device of claim 1, wherein said vertical support member is hollow.

3. The well drilling fishing equipment alignment device of claim 1, wherein said vertical support member includes a lower end guide support configured to engage and mate with a feature of an equipment retrieval device.

4. The well drilling fishing equipment alignment device of claim 3, wherein said guide support includes a perimeter lip that engages a bottom edge of an equipment retrieval device.

5. The well drilling fishing equipment alignment device of claim 4, wherein said perimeter lip mates with the bottom edge to form at least one joint.

6. The well drilling fishing equipment alignment device of claim 4, wherein an upper perimeter lip includes a vertically orientated straight edge and a helical edge.

7. An overshot alignment structure, comprising:

an overshot; and, an overshot alignment device having a base, an inner support connected to and extending up from said base, said inner support holding said overshot such that said overshot extends vertically, and an outer cover protecting at least part of said overshot and, wherein said base includes a base member having a top, wherein said base further includes a bottom base plate under the base member, wherein said base plate provides a flat bottom for mating with a flat surface, wherein said base further comprises at least one handling feature that extends upward from said top, wherein said inner support includes a vertical support member that is connected at its lower end to said base member.

8. The overshot alignment structure of claim 7, wherein said vertical support member is hollow.

9. The overshot alignment structure of claim 7, wherein said vertical support member includes a lower end guide support that mates with said overshot.

10. The overshot alignment structure of claim 9, wherein said guide support includes a perimeter lip that engages the bottom edge of a guide in said overshot.

11. The overshot alignment structure of claim 10, wherein said perimeter lip mates with the bottom edge to form a joint.

12. The overshot alignment structure of claim 10, wherein an upper perimeter lip includes a vertically orientated straight edge and a helical edge.

* * * * *